US007567156B2

(12) United States Patent
Westphal et al.

(10) Patent No.: US 7,567,156 B2
(45) Date of Patent: Jul. 28, 2009

(54) SUPERCONDUCTING MAGNET CONFIGURATION WITH SWITCH

(75) Inventors: Michael Westphal, Offenbach (DE); Victor Ringeisen, Riedseltz (FR)

(73) Assignee: Bruker Biospin GmbH, Rheinstetien (DE)

( * ) Notice: Subject to any disclaimer, the term of this patent is extended or adjusted under 35 U.S.C. 154(b) by 19 days.

(21) Appl. No.: 11/488,771

(22) Filed: Jul. 19, 2006

(65) Prior Publication Data

US 2007/0024404 A1 Feb. 1, 2007

(30) Foreign Application Priority Data

Jul. 26, 2005 (DE) ..... 10 2005 034 837

(51) Int. Cl.
*H01F 7/00* (2006.01)
*H01F 6/00* (2006.01)
*H01F 1/00* (2006.01)

(52) U.S. Cl. ..... 335/216

(58) Field of Classification Search ..... 335/216
See application file for complete search history.

(56) References Cited

U.S. PATENT DOCUMENTS

| | | | | | |
|---|---|---|---|---|---|
| 3,210,610 | A * | 10/1965 | Fraser | 361/141 |
| 3,486,079 | A * | 12/1969 | Arp | 361/141 |
| 4,689,439 | A * | 8/1987 | Sato | 174/15.4 |
| 4,969,064 | A * | 11/1990 | Shadowitz | 361/141 |
| 5,218,505 | A * | 6/1993 | Kubo et al. | 361/19 |
| 5,686,877 | A * | 11/1997 | Keller et al. | 335/216 |
| 6,445,555 | B1 * | 9/2002 | Buckles et al. | 361/19 |
| 6,624,732 | B2 * | 9/2003 | Biltcliffe et al. | 335/216 |
| 6,717,781 | B2 * | 4/2004 | Xu et al. | 361/19 |
| 6,897,749 | B2 * | 5/2005 | Jonsson et al. | 335/216 |
| 7,157,999 | B2 * | 1/2007 | Kasten | 335/216 |
| 7,224,250 | B2 * | 5/2007 | Nemoto et al. | 335/216 |
| 2001/0028542 | A1 * | 10/2001 | Kuperman et al. | 361/18 |
| 2004/0114403 | A1 * | 6/2004 | Jonsson et al. | 363/75 |

FOREIGN PATENT DOCUMENTS

| | | | |
|---|---|---|---|
| JP | 59 113 605 | | 6/1984 |
| JP | 06350148 | A * | 12/1994 |
| WO | WO 2004/079831 | | 9/2004 |

* cited by examiner

*Primary Examiner*—Elvin G Enad
*Assistant Examiner*—Alexander Talpalatskiy
(74) *Attorney, Agent, or Firm*—Paul Vincent

(57) ABSTRACT

A superconducting magnet configuration with a magnet coil (1) of inductance L which is disposed in a cryostat (7) at a cryogenic temperature, for generating a temporally stable magnetic field, in a working volume, which is suitable for NMR measurements, and with current feed lines to an external current source (3) via which a current of a current strength $I_{PS}$ can be supplied, wherein, at a cryogenic temperature, the magnet coil (1) can be exclusively short-circuited via a switch (5), is characterized in that the switch (5) is normally conducting and comprises a mechanically operable bridge (6) with an ohmic resistance R1 which can be predetermined. The inventive magnet configuration ensures straightforward stable permanent operation via a mains supply even at high currents (>1000 A) and also effective discharge of the energy released during a quench.

12 Claims, 2 Drawing Sheets

SUPERCONDUCTING MAGNET CONFIGURATION WITH SWITCH

This application claims Paris Convention priority of DE 10 2005 034 837.8 filed Jul. 26, 2005 the complete disclosure of which is hereby incorporated by reference.

BACKGROUND OF THE INVENTION

The invention concerns a superconducting magnet configuration with a magnet coil of inductance L, which is disposed in a cryostat at a cryogenic temperature to generate a temporally stable magnetic field, in a working volume, suitable for NMR measurements, and with current feed lines to an external current source, via which a current of current strength $I_{PS}$ can be supplied, wherein the inductance at cryogenic temperatures can be exclusively short-circuited via a switch.

A magnet configuration of this type is disclosed In DE 102 41 966.

Superconducting magnet coils that generate a stable magnetic field are required for a plurality of applications in research and medicine, in particular for NMR apparatus. For this reason, the field drift of the magnet coil should be minimized.

The magnet coil disclosed in DE 102 41 966 can be short-circuited via a superconducting switch which is connected in series with a resistance. During operation, the magnet coil is constantly supplied with current from a current source to generate a desired magnetic field in a working volume and to keep the sum of voltages in the circuit at zero and thereby also the magnetic field drift.

This configuration is disadvantageous, since superconducting switches tend to immediately quench at high currents. During a quench, the current circulating in the magnet coil must be discharged quickly via an external resistor thereby producing a very large discharge voltage, which is also present at the superconducting switch. This can easily destroy the superconducting switch. In order to prevent this, a large number of long switch wires are generally required to carry the current, without being damaged. However, this increases the amount of material required.

Another solution is to embed the superconducting wire of the switch in a CuNi matrix in order to obtain a high resistance using little wire. These wires are, however, very unstable and are therefore suitable for the above-mentioned application only to a limited degree.

The use of superconducting switches is conventionally preferred, since it yields an almost infinite time constant to ensure stable operation of the magnet configuration.

It is the underlying object of the invention to propose a superconducting magnet configuration which ensures stable permanent operation via mains supply even at high currents (>1000 A) with little technical expense, and effectively discharges the energy released during a quench.

SUMMARY OF THE INVENTION

This object is achieved in accordance with the invention in that that the switch is normally conducting and comprises a mechanically operable bridge with an ohmic resistance which can be predetermined.

With the use of a normally conducting switch, the inventive magnet configuration is less susceptible to a quench and can be operated at higher currents. This is interesting, in particular, for high-performance magnets. The magnetic drift may also be effectively compensated for via the strength of the current fed by the mains supply and the predetermined ohmic resistance of the mechanically operable bridge.

Since the inductance represents a resistance for high frequency, high-frequency current changes are not transferred to the generated magnetic field, such that the ripple of the generated magnetic field can be minimized. In this manner, the system can be operated with higher stability than the mains supply. Even when the switch is opened, the stability of the system only drops to that of the mains supply. The inventive configuration therefore provides effective short-circuiting of temporary fluctuations.

In a preferred embodiment of the inventive magnet configuration, the ohmic resistance of the mechanically operable bridge is smaller than $10^{-3}\Omega$, preferably approximately $10^{-6}\Omega$.

It is also advantageous for the external current source to have a relative stability of $$\frac{\Delta I_{PS}}{I_{PS}} < 10^{-2}.$$

DC mains supply units with $$\frac{\Delta I_{PS}}{I_{PS}} < 10^{-5}$$

are thereby preferably used.

The inventive magnet configuration is also suited for mains supplies of poorer quality, such that stable operation is possible even when the external current source has a relative stability of $$\frac{\Delta I_{PS}}{I_{PS}} > 10^{-4}.$$

Since magnet configurations with superconducting switches tend to be particularly unstable at high currents, the invention is particularly advantageous when the current supplied from the external current source is larger than 1000 A.

A magnetic field with large temporal stability can be achieved when the inductance of the inventive magnet configuration is large, preferably larger than 10 H [Henry].

The inventive magnet configuration is also advantageous in the undesired case when the inductance comprises a parasitic ohmic resistance $R_L$, wherein $10^{-9}\Omega \leqq R_L \leqq 10^{-6}\Omega$. The drift of the magnetic field which, in this case is normally conducting, can be compensated for through selection of the ohmic resistance of the mechanically operable bridge and the strength of the current $I_{PS}$.

In one particularly advantageous embodiment of the inventive magnet configuration, the current feed lines outside of the region of cryogenic temperature can be short-circuited via a discharging resistance. In case of a quench, the normally conducting switch can be opened. This is realized by means of the mechanically operable bridge in that the resistance forming the switch is merely pulled out of the circuit and the contact to the circuit is interrupted. The current may then be discharged via the external discharging resistance. In this fashion, the energy produced by the quench can be effectively discharged without destroying the switch.

In a further development of this embodiment, the following applies for the time constant $$\tau_3 = \frac{L}{R3}$$

of the magnet configuration: $10\ s \leqq \tau_3 \leqq 1000\ s$.

In one particular embodiment of the invention, the switch can be mechanically operated from outside of the cryostat. This permits external control of the normally conducting switch.

The mechanically operable bridge can advantageously be replaced without heating the magnet coil. Operation of the magnet coil must therefore not be interrupted. A change and/or replacement of the resistance of the mechanically operable bridge can be realized in a simple fashion.

In a particularly advantageous fashion, the mechanically operable bridge comprises superconducting material. The resistance of the bridge is then less than $10^{-9}\Omega$ and permits real short-circuit operation when the feed lines are disconnected.

In a particularly preferred embodiment, at least one quench sensor is disposed on the magnet coil which generates an output signal that is supplied to a control unit, wherein the control unit opens the switch and shuts off the current source in case of a quench.

Further advantages of the invention can be extracted from the description and the drawing. The features mentioned above and below may be used individually or collectively in arbitrary combination. The embodiments shown and described are not to be understood as exhaustive enumeration but have exemplary character for describing the invention.

DESCRIPTION OF THE PREFERRED EMBODIMENT

Figure 2:
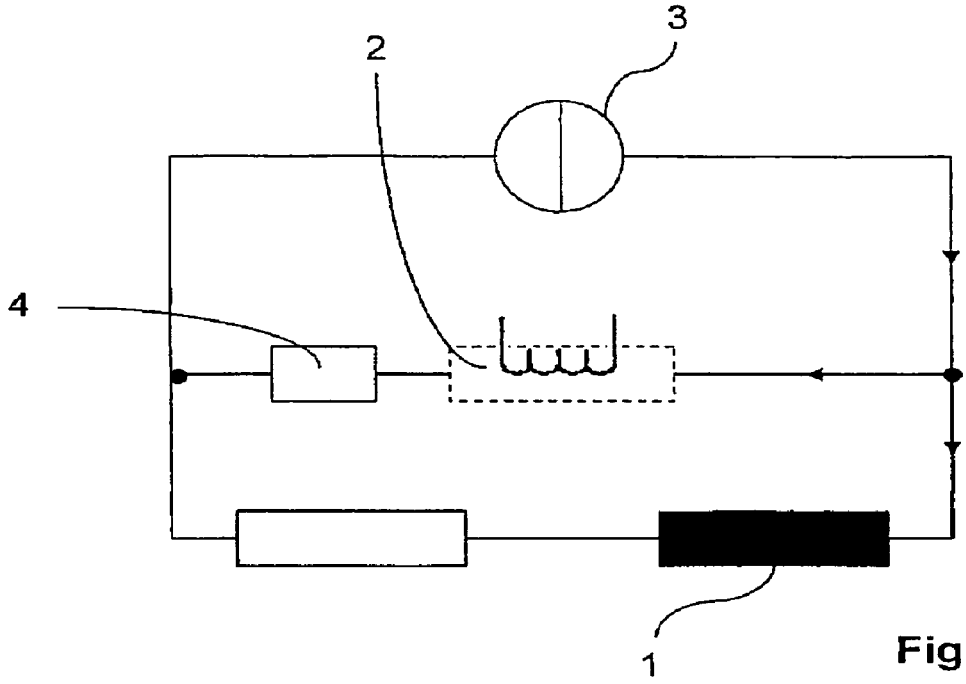
Fig. 2 PRIOR ART
FIG. 2 shows a circuit of a magnet configuration according to prior art.

FIG. 2 shows a circuit of a conventional magnet configuration. A magnet coil 1 is connected in parallel with a superconducting switch 2 and a current source 3 which supplies the magnet coil 1 with a current $I_{PS}$. The superconducting switch 3 remains open until the required magnetic field has been generated in the working volume. The magnet coil 1 can be short-circuited by closing the superconducting switch 2. When the switch 2 is closed, the current supply must remain connected. In order to minimize the magnetic field drift due to the intrinsic resistance of the magnet coil 1, the superconducting switch 2 is connected in series with a protective resistance 4, wherein the resistance 4 is much larger than the intrinsic resistance of the magnet coil 1. A voltage, which is exactly opposite to the voltage generated by the intrinsic resistance of the magnet coil, is generated at this protective resistance 4 by means of the current source 3, such that the algebraic sum of the circuit voltages is zero.

These configurations create problems, in particular, for high-performance magnets requiring very high currents to generate desired magnetic fields, since superconducting switches 2 tend to instantaneously quench in case of such high currents. Superconducting switches 2 are also easily destroyed by a magnet quench, which requires more frequent, time-consuming replacement of the switch 2.

Figure 1:
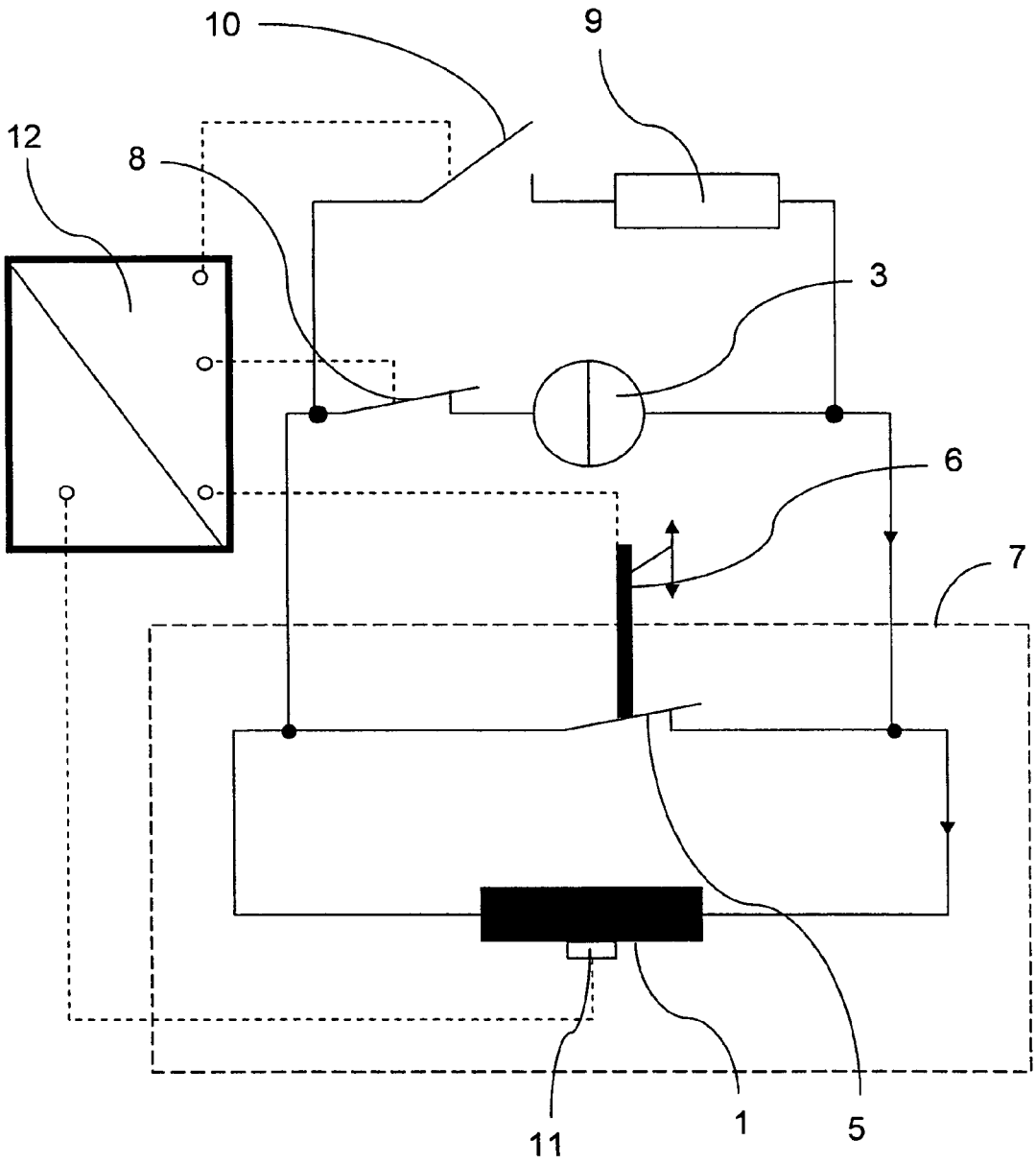
FIG. 1 shows a circuit of an inventive magnet configuration comprising a normally conducting switch, a mechanically operable bridge and a control unit.

The magnet configuration shown in FIG. 1 comprises a normally conducting switch 5 (e.g. of copper) having a mechanically operable bridge 6 instead of a superconducting switch 2. The magnet coil 1 is connected in parallel with the normally conducting switch 5 and the current source 3, wherein the magnet coil 1 and the normally conducting switch 5, and also at least parts of the mechanically operable bridge 6 are within a cryostat 7. The magnet coil 1 is connected to the current source 3 outside of the cryostat 7 via a switch 8. An external discharging resistance 9 of a value R3 is connected in parallel to the current source 3, which can, in turn, be separated from the circuit of the magnet coil 1 via a switch 10.

The use of normally conducting switches is usually problematic in that the time constant which is a criterion for the stability of the magnetic field is not infinite. Magnets comprising normally conducting switches are therefore generally less stable than those with superconducting switches. The inventive magnet configuration, however, is designed to ensure stable operation.

The switches 5, 8 remain closed during normal operation, while the switch 10 upstream of the discharging resistance 9 is open. The magnet coil of the inventive magnet configuration is therefore permanently connected to a current source 3. No current flows through the normally conducting switch 5 during normal operation due to the high resistance compared to the resistance of the magnet coil.

In order to effectively compensate not only for temporary (high-frequency) fluctuations, the configuration, like the magnet configuration of FIG. 2, must be supplied with an increased current $I_{PS}=I_0+\epsilon$ compared to the current $I_0$ required to generate the magnetic field in order to compensate for this drift. The magnitude of the required current thereby depends on the time constant of the configuration. The use of the normally conducting switch 5, which already has an ohmic resistance, obviates connecting an additional protective resistor 4 in series with the switch 5, in contrast to the magnet configuration of FIG. 2.

The inventive switch 5 is provided with a mechanically operable bridge 6 having a resistance value R1, wherein the bridge 6 is not soldered but can be simply pulled out. This permits change of the resistance value R1 depending on the requirements without heating the magnet coil 1, such that operation can be continued without disturbance during exchange of the resistance value R1 of the bridge 6. It is also feasible to exchangeably dispose several bridges 6 having different resistance values R1 in the cryostat, e.g. in the form of a rotatable magazine. The resistance R1 of the mechanically operable bridge 6 can therefore be arbitrarily adjusted.

The advantages of the invention show, in particular, in the improved stability of the configuration, since the danger of a quench of the system is highly reduced by omitting a superconducting switch. Even in case of a quench, the inventive magnet configuration has improved properties compared to prior art. Towards this end, the magnet configuration of FIG. 1 is provided with a quench sensor 11 which generates an output signal which is supplied to a control unit 12. The control unit 12 closes the switch 10, reduces the current of the current source 3 and opens the switches 5, 8 in case of a quench. In this manner, the magnet coil 1 is discharged via the discharging resistance 9. Due to the reduced sensitivity of the normally conducting switch 5 compared to superconducting switches, the danger of damaging the switch 5 located in the cryostat 7 of the inventive magnet configuration is reduced compared to conventional configurations with superconducting switches.

The inventive configuration yields a stability (with closed switch 5) which exceeds the stability of the used current source 3 by orders of magnitude. The magnet configuration can e.g. be operated with a current source 3 of a stability $10^{-5}$ at a current strength of 1500 A, which is typical for high-performance magnets, with a stability of the magnet configuration of $10^{-10}$.

The inventive magnet configuration ensures straightforward, reliable operation, in particular, of high-performance magnets with an extremely high stability and effective discharge of the energy released during a quench.

LIST OF REFERENCE NUMERALS

1 magnet coil
2 superconducting switch
3 current source
4 protective resistance
5 normally conducting switch
6 bridge
7 cryostat
8 switch at the current source
9 discharging resistance
10 switch at the discharging resistance
11 quench sensor
12 control unit

We claim:

1. A superconducting magnet configuration, the configuration comprising:

a cryostat at a cryogenic temperature;

a magnet coil of inductance L larger than 10 H [Henry], said magnet coil disposed in said cryostat and generating a temporally stable magnetic field in a working volume which is suitable for NMR measurements;

an external current source supplying a current strength $I_{PS}$;

current feed lines connected between said current source and said magnet coil for passing said current strength $I_{PS}$ from said current source to said magnet coil; and a switch, said switch structured, disposed and dimensioned to exclusively short-circuit said magnet coil at said cryogenic temperature, wherein said switch is normally conducting and comprises a mechanically operable bridge having a definable ohmic resistance R1 smaller than $10^{-3}\Omega$, said switch and parts of said bridge being disposed within said cryostat, wherein said external current source has a ripple whose frequency dependence is such that a relative stability of the magnetic field generated by said magnet coil exceeds a relative stability of said external current source, associated with said ripple, by at least three orders of magnitude.

2. The superconducting magnet configuration of claim 1, wherein said ohmic resistance R1 is approximately $10^{-6}\Omega$.

3. The superconducting magnet configuration of claim 1, wherein said external current source has a relative stability of $$\frac{\Delta I_{PS}}{I_{PS}} < 10^{-2}.$$

4. The superconducting magnet configuration of claim 1, wherein said external current source has a relative stability of $$\frac{\Delta I_{PS}}{I_{PS}} > 10^{-4}.$$

5. The superconducting magnet configuration of claim 1, wherein said current $I_{PS}$ supplied from said external current source is larger than 1000 A.

6. The superconducting magnet configuration of claim 1, wherein said magnet coil comprises a parasitic ohmic resistance $R_L$, wherein $10^{-9}\Omega \leqq R_L \leqq 10^{-6}\Omega$.

7. The superconducting magnet configuration of claim 1, further comprising means for short-circuiting said current feed lines outside of a region of cryogenic temperature via a discharging resistance of magnitude $R_3$.

8. The superconducting magnet configuration of claim 7, wherein said magnet coil has a time constant $$\tau_3 = \frac{L}{R3},$$

wherein $10\ s \leqq \tau_3 \leqq 1000\ s$.

9. The superconducting magnet coil of claim 1, wherein said switch can be mechanically operated from outside said cryostat.

10. The superconducting magnet coil of claim 1, wherein said mechanically operable bridge can be exchanged without heating said magnet coil.

11. The superconducting magnet coil of claim 1, wherein said mechanically operable bridge comprises superconducting material.

12. The superconducting magnet coil of claim 1, further comprising a control unit and at least one quench sensor disposed on said magnet coil to generate an output signal that is supplied to said control unit, wherein said control unit opens said switch and shuts down said current source in response to a quench.

* * * * *